US011703781B2

(12) United States Patent
Iwaya

(10) Patent No.: US 11,703,781 B2
(45) Date of Patent: Jul. 18, 2023

(54) FIXING DEVICE AND IMAGE FORMING APPARATUS WHICH HAS AN AIR FLOW GENERATOR AND AIRFLOW GUIDE

(71) Applicant: Naoki Iwaya, Tokyo (JP)

(72) Inventor: Naoki Iwaya, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/407,237

(22) Filed: Aug. 20, 2021

(65) Prior Publication Data

US 2022/0066368 A1 Mar. 3, 2022

(30) Foreign Application Priority Data

Aug. 28, 2020 (JP) ..... 2020-144730

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS

2011/0229200 A1 9/2011 Yamaguchi et al.
2012/0002997 A1* 1/2012 Hiraoka ..... G03G 15/2064 399/92
2016/0098009 A1* 4/2016 Aoki ..... G03G 15/2042 399/92
2016/0246223 A1* 8/2016 Yabuki ..... G03G 15/2017
2017/0003633 A1 1/2017 Hase et al.
2019/0258196 A1* 8/2019 Iwaya ..... G03G 15/2053
2022/0091546 A1* 3/2022 Saitoh ..... G03G 15/2064

FOREIGN PATENT DOCUMENTS

JP 5-053462 3/1993
JP 2005-352193 12/2005
JP 2005352193 A * 12/2005
JP 5747013 B2 * 7/2015 ..... G03G 15/2017
JP 2015200812 A * 11/2015 ..... G03G 15/2017
JP 2017-015882 1/2017

OTHER PUBLICATIONS

JP5747013B2 to GON, Computer Translation (Year: 2017).*

* cited by examiner

*Primary Examiner* — Quana Grainger
(74) *Attorney, Agent, or Firm* — Xsensus LLP

(57) ABSTRACT

A fixing device includes a fixing belt, a nip formation pad, a support, an opposing rotator, a heat source, a housing, an inlet guide, an airflow generator, and an airflow guide. The fixing belt fixes an unfixed image on a recording medium. The nip formation pad is disposed inside a loop of the fixing belt. The support supports the nip formation pad. The opposing rotator abuts on the nip formation pad via the fixing belt. The heat source heats the fixing belt. The housing has an inlet opening to receive the recording medium. The inlet guide is disposed at the inlet opening and guides the recording medium to the fixing nip. The airflow generator generates an airflow in the housing. The airflow guide guides the airflow toward the inlet opening to generate a flow of air in the inlet opening in a direction different from a conveyance direction.

16 Claims, 4 Drawing Sheets

FIXING DEVICE AND IMAGE FORMING APPARATUS WHICH HAS AN AIR FLOW GENERATOR AND AIRFLOW GUIDE

CROSS-REFERENCE TO RELATED APPLICATION

This patent application is based on and claims priority pursuant to 35 U.S.C. § 119(a) to Japanese Patent Application No. 2020-144730, filed on Aug. 28, 2020, in the Japan Patent Office, the entire disclosure of which is incorporated by reference herein.

BACKGROUND

Technical Field

Embodiments of the present disclosure relate to a fixing device and an image forming apparatus.

Related Art

As a fixing device used in an image forming apparatus such as a printer or a copying machine, for example, there is known a fixing device that includes a fixing roller and a pressure roller. The fixing roller includes a heat source inside and rotates. The pressure roller rotates while being pressed against the fixing roller. The fixing device passes a recording medium through a fixing nip formed by contact between the fixing roller and the pressure roller, melts and fixes an unfixed toner on the recording medium in the fixing nip. Further, for the purpose of reducing the thermal capacity of the fixing member and improving the heat transfer efficiency to the recording medium, there is also known a fixing device that includes a fixing rotator (e.g., a fixing belt or a fixing sleeve) using an endless belt-shaped member instead of a fixing roller with a heat source, or a pressure rotator.

SUMMARY

In an aspect of the present disclosure, there is provided a fixing device that includes a fixing belt, a nip formation pad, a support, an opposing rotator, a heat source, a housing, an inlet guide, an airflow generator, and an airflow guide. The fixing belt is rotatable and has an endless shape, and fixes an unfixed image on a recording medium conveyed to a fixing nip. The nip formation pad is disposed inside a loop of the fixing belt. The support supports the nip formation pad. The opposing rotator abuts on the nip formation pad via the fixing belt to form the fixing nip between the opposing rotator and the fixing belt. The heat source heats the fixing belt. The housing accommodates the fixing belt, the nip formation pad, the support, the opposing rotator, and the heat source, and has an inlet opening to receive the recording medium. The inlet guide is disposed at the inlet opening and guides the recording medium to the fixing nip. The airflow generator generates an airflow in the housing of the fixing device. The airflow guide guides the airflow toward the inlet opening to generate a flow of air in the inlet opening in a direction different from a conveyance direction in which the recording medium is conveyed to the inlet opening.

In another aspect of the present disclosure, there is provided an image forming apparatus that includes the fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
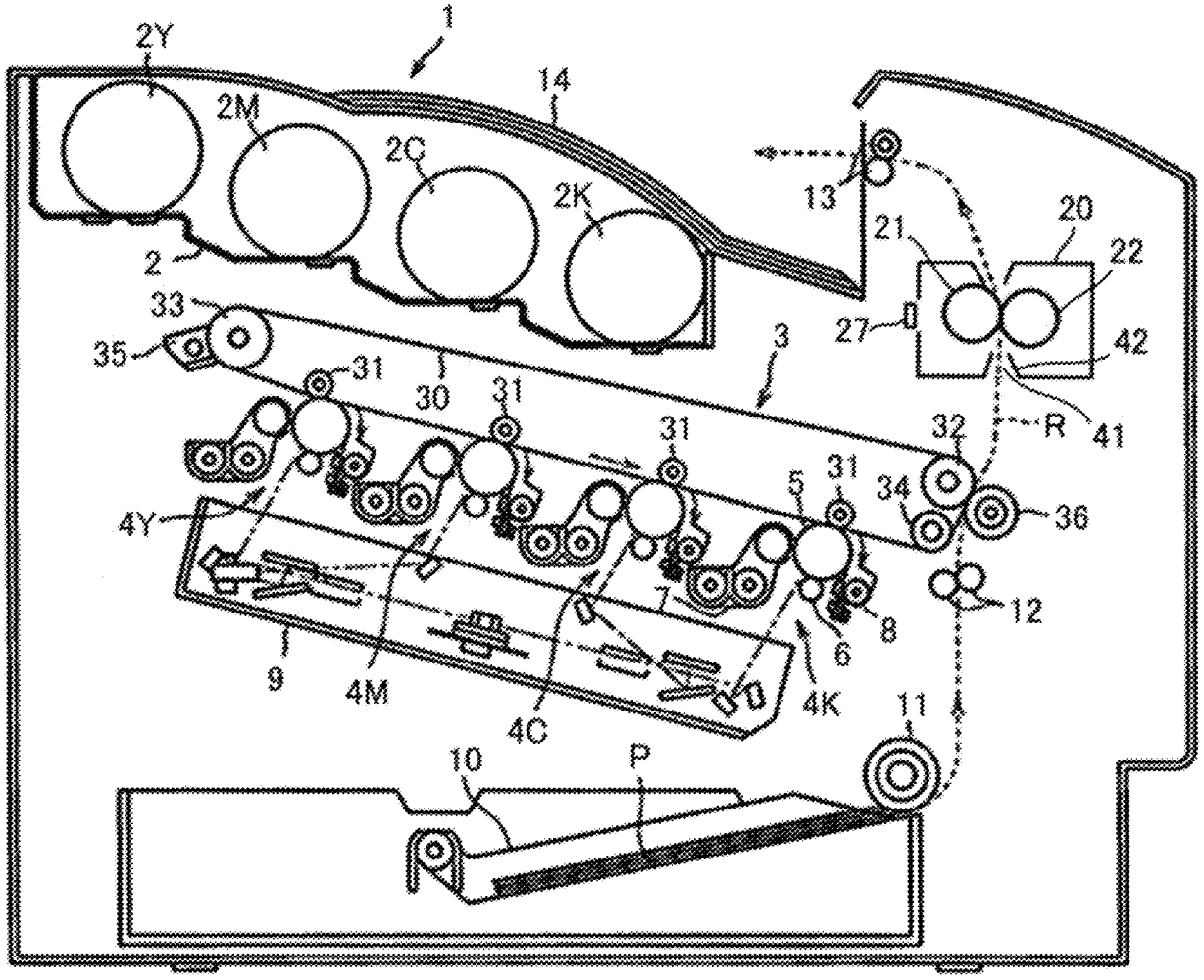
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given below of a printer (an electrophotographic image forming apparatus) as an image forming apparatus according to an embodiment of the present disclosure with reference to drawings. The image forming apparatus according to the present embodiment includes a fixing device according to an embodiment of the present disclosure described later.

FIG. 1 is a schematic view of a printer as an image forming apparatus 1 according to an embodiment of the present disclosure. Four image forming devices 4Y, 4M, 4C, and 4K are disposed in the center of a main body of the image forming apparatus 1. The image forming devices 4Y, 4M, 4C, and 4K have substantially the same configuration except for containing different color developers (e.g., toners) of yellow (Y), magenta (M), cyan (C), and black (K), respectively, corresponding to color separation components of color images. Specifically, each of the image forming devices 4Y, 4M, 4C, and 4K includes, e.g., a drum-shaped photoconductor 5 serving as a latent image bearer, a charger 6 that charges the surface of the photoconductor 5, a developing device 7 that supplies toner to the surface of the photoconductor 5, and a cleaner 8 that cleans the surface of the photoconductor 5. It is to be noted that, in FIG. 1, reference numerals are assigned to the photoconductor 5, the charger 6, the developing device 7, and the cleaner 8 of the image forming device 4K that forms a black toner image, whereas reference numerals for components of the other image forming devices 4Y, 4M, and 4C that form yellow, magenta, and cyan toner images are omitted.

Below the image forming devices 4Y, 4M, 4C, and 4K, an exposure device 9 that exposes the surface of the photoconductor 5 is disposed. The exposure device 9 includes, e.g., a light source, a polygon mirror, an f-θ lens, and a reflection mirror to irradiate the surface of each photoconductor 5 with a laser beam according to image data. A transfer device 3 is disposed above the image forming devices 4Y, 4M, 4C, and 4K. The transfer device 3 includes an intermediate transfer belt 30 (serving as a transfer body), four primary transfer rollers 31 (serving as primary transferors), and a secondary transfer roller 36 (serving as a secondary transferor), a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise in FIG. 1, the intermediate transfer belt 30 rotates counterclockwise as indicated by an arrow in FIG. 1 by friction therebetween.

The four primary transfer rollers 31 sandwich the intermediate transfer belt 30 together with the respective photoconductors 5, thereby forming four primary transfer areas, herein referred to as primary transfer nips. Each primary transfer roller 31 is connected to a power supply that applies a predetermined direct current (DC) voltage and/or alternating current (AC) voltage to each primary transfer roller 31.

The secondary transfer roller 36 sandwiches the intermediate transfer belt 30 together with the secondary transfer backup roller 32, thereby forming a secondary transfer area, herein referred to as a secondary transfer nip, between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage to the secondary transfer roller 36.

The belt cleaner 35 includes a cleaning brush and a cleaning blade that contact an outer circumferential surface of the intermediate transfer belt 30. A waste-toner conveyance tube extending from the belt cleaner 35 to an inlet of a waste-toner container conveys waste toner collected from the intermediate transfer belt 30 by the belt cleaner 35 to the waste-toner container.

A bottle holder 2 disposed in an upper portion of the image forming apparatus 1 accommodates four toner bottles 2Y, 2M, 2C, and 2K detachably attached to the bottle holder 2. The toner bottles 2Y, 2M, 2C, and 2K contain fresh yellow, cyan, magenta, and black toners to be supplied to the developing devices 7 of the image forming devices 4Y, 4M, 4C, and 4K, respectively. The fresh toner is supplied from the toner bottles 2Y, 2M, 2C, and 2K to the respective developing devices 7 through toner supply tubes connected between the toner bottles 2Y, 2M, 2C, and 2K and the respective developing devices 7.

A sheet tray 10 and a feed roller 11 are disposed in a lower portion of the image forming apparatus 1. The sheet tray 10 accommodates a plurality of sheets P (serving as recording media). The feed roller 11 feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Additionally, a bypass tray may be attached to the image forming apparatus 1 to place such recording media thereon.

The image forming apparatus 1 includes a conveyance passage R to convey the sheet P from the sheet tray 10 to the output roller pair 13 via the secondary transfer nip. In the conveyance passage R, a registration roller pair 12 as a conveyance device to convey the sheet P to the secondary transfer nip is disposed upstream from the secondary transfer roller 36 in the sheet conveyance direction.

The fixing device 20 is disposed downstream from the secondary transfer roller 36 in the sheet conveyance direction. The fixing device 20 receives the sheet P bearing an unfixed toner image and fixes the toner image onto the sheet P. In the conveyance passage R downstream from the fixing device 20 in the sheet conveyance direction, an output roller pair 13 ejects the sheet P outside the main body of the image forming apparatus 1. An output tray 14 stocks the sheet P ejected by the output roller pair 13.

With reference to FIG. 1, basic operations of the printer as the image forming apparatus 1 according to the present embodiment are described below. When a print job starts, the photoconductor 5 of each of the imaging forming devices 4Y, 4M, 4C, and 4K is rotated by a driver in a clockwise direction in FIG. 1. The charger 6 uniformly charges the outer circumferential surface of each photoconductor 5 with an electrical charge of a specified polarity. The exposure device 9 emits laser beams onto the charged outer circumferential surfaces of the respective photoconductors 5, thus forming electrostatic latent images on the respective photoconductors 5. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the respective photoconductors 5, visualizing (visualized image) the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the direction indicated by the arrow in FIG. 1 by friction therebetween. The power supply applies a constant voltage or constant current control voltage having a polarity opposite a polarity of the charged toner to the respective primary transfer rollers 31. Accordingly, a transfer electric field is generated at each of the primary transfer nips between the respective primary transfer rollers 31 and the respective photoconductors 5.

When the yellow, magenta, cyan, and black toner images formed on the respective photoconductors 5 reach the primary transfer nips in accordance with rotation of the respective photoconductors 5, the yellow, magenta, cyan, and black toner images are primarily transferred from the respective photoconductors 5 onto the intermediate transfer belt 30 by the transfer electric field created at the primary transfer nips such that the yellow, magenta, cyan, and black toner images are superimposed successively one on another on the intermediate transfer belt 30. Thus, a full-color toner image is formed on the surface of the intermediate transfer belt 30. The cleaner 8 removes residual toner, which has failed to be transferred onto the intermediate transfer belt 30 and remaining on the surface of the photoconductor 5, from the photoconductor 5. Thereafter, dischargers discharge the outer circumferential surfaces of the respective photoconductors 5, initializing a surface potential thereof.

On the other hand, the feed roller 11 disposed in the lower portion of the image forming apparatus 1 is driven and rotated to feed the sheet P from the sheet tray 10 toward the registration roller pair 12 through the conveyance passage R. The registration roller pair 12 is timed to convey the sheet P, fed to the conveyance passage R, to the secondary transfer nip between the secondary transfer roller 36 and the secondary transfer backup roller 32 so that the sheet P meets the full-color toner image formed on the surface of the intermediate transfer belt 30 at the secondary transfer nip. The secondary transfer roller 36 is supplied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, magenta, cyan, and black constructing the full-color toner image from the intermediate transfer belt 30 onto the sheet P collectively. The belt cleaner 35 removes the residual toner, which has failed to be transferred onto the sheet P and remaining on the intermediate transfer belt 30, from the intermediate transfer belt 30. The removed toner is conveyed and collected into the waste-toner container.

Thereafter, the sheet P bearing the full-color toner image is conveyed to the fixing device 20 that fixes the full-color toner image on the sheet P. Then, the sheet P bearing the fixed full-color toner image is conveyed to the output roller pair 13 that ejects the sheet P onto the output tray 14 atop the image forming apparatus 1. Thus, the plurality of sheets P is stacked on the output tray 14.

As described above, the image forming apparatus 1 forms a full-color image on the sheet P. Alternatively, the image forming apparatus 1 may use one of the image forming devices 4Y, 4M, 4C, and 4K to form a monochrome image, or may use two or three of the image forming devices 4Y, 4M, 4C, and 4K to form a bicolor or tricolor image, respectively.

Figure 2:
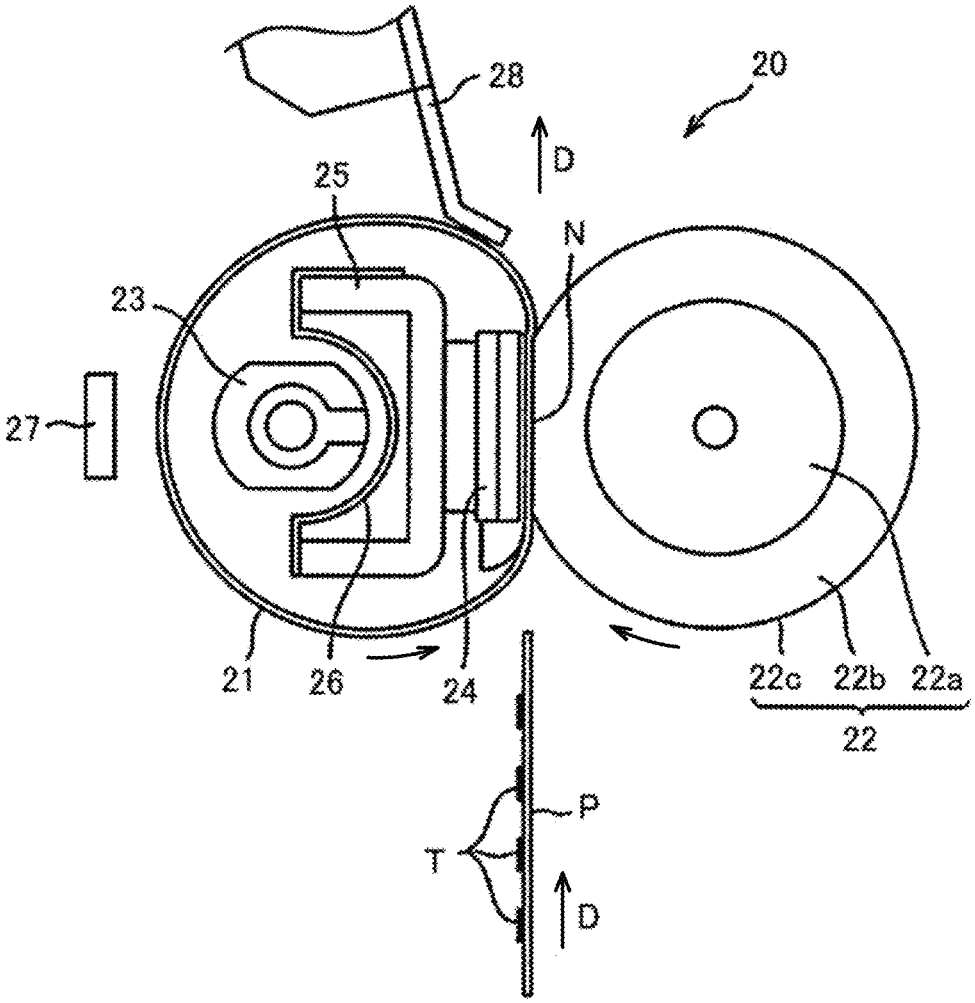
FIG. 2 is a schematic view of a main part of a fixing device according to an embodiment of the present disclosure.

Next, a configuration of the fixing device 20 according to an embodiment of the present disclosure is described with reference to FIG. 2. As illustrated in FIG. 2, the fixing device 20 includes an endless rotatable fixing belt 21 (serving as a fixing rotator), a pressure roller 22 (serving as an opposite rotator) rotatably disposed opposite the fixing belt 21, a heat source (also referred to as a halogen heater) 23 serving as a heater to heat the fixing belt 21, a nip formation pad 24 disposed inside a loop of the fixing belt 21, a support 25 (serving as a stay) to support the nip formation pad 24, a reflector 26 to reflect light radiated from the halogen heater 23 toward the fixing belt 21, a temperature detector 27 to detect the temperature of the fixing belt 21, a separator 28 to separate the sheet P from the fixing belt 21, and a biasing mechanism that presses the pressure roller 22 against the fixing belt 21.

The fixing belt 21 is a thin, flexible, endless belt member (which may be a film). The fixing belt 21 includes a base layer to form the inner circumferential surface of the fixing belt 21 and a release layer to form the outer circumferential surface of the fixing belt 21. The base layer is made of metal such as nickel or stainless steel (Stainless Used Steel, SUS). Alternatively, the base layer may be made of resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, or fluoro rubber may be interposed between the base layer and the release layer.

The pressure roller 22 includes a cored bar 22*a*; an elastic layer 22*b* disposed on the surface of the cored bar 22*a*, which is made of foamed silicone rubber, silicon rubber, or the fluoro-rubber; and a release layer 22*c* disposed on the surface of the elastic layer 22*b*, which is made of, for example, PFA or PTFE. The biasing mechanism presses the pressure roller 22 against the fixing belt 21. Thus, the pressure roller 22 abuts on the nip formation pad 24 via the fixing belt 21. The pressure roller 22 in pressure contact with the fixing belt 21 deforms the elastic layer 22*b* of the pressure roller 22, thus defining a fixing nip N having a specified width, which is a specified length in the sheet conveyance direction, between the fixing belt 21 and the pressure roller 22. A driver such as a motor disposed inside the main body of the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22.

In the fixing device 20 illustrated in FIG. 2, the pressure roller 22 is a solid roller. Alternatively, the pressure roller 22 may be a hollow roller. In a case in which the pressure roller 22 is a hollow roller, a heat source such as a halogen heater may be disposed inside the pressure roller 22. If the pressure roller 22 does not include the elastic layer 22*b*, the pressure roller 22 has a decreased thermal capacity and can be heated quickly to a specified fixing temperature at which a toner image T is fixed on the sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in unevenness in gloss of the solid toner image T. To address such a situation, the fixing belt 21 preferably incorporates an elastic layer having a thickness not smaller than 100 μm. The elastic layer having a thickness not smaller than 100 μm elastically deforms to absorb the slight surface asperities in the fixing belt 21, thus preventing the unevenness in gloss of the toner image on the sheet P. The elastic layer 22*b* of the pressure roller 22 may be made of solid rubber. Alternatively, if no heater is disposed inside the pressure roller 22, the elastic layer of the pressure roller 22 may be made of sponge rubber. The sponge rubber is preferable to the solid rubber because the sponge rubber has enhanced thermal insulation that draws less heat from the fixing belt 21. According to this embodiment, the pressure roller 22 is pressed against the fixing belt 21. Alternatively, the fixing rotator may merely contact the opposite rotator with no pressure therebetween.

Both ends of the halogen heater 23 are secured to side plates of the fixing device 20. A power supply disposed inside the main body of the image forming apparatus 1 supplies power to the halogen heater 23 so that the halogen heater 23 generates heat. A controller operatively connected to the halogen heater 23 and the temperature detector 27 controls the halogen heater 23 based on the temperature of the outer circumferential surface of the fixing belt 21, which is detected by the temperature detector 27. Such heating control of the halogen heater 23 adjusts the temperature of the fixing belt 21 to a desired fixing temperature. As the heat source that heats the fixing belt 21, an induction heater (IH), a resistive heat generator, a carbon heater, or the like may be employed instead of the halogen heater 23.

The nip formation pad 24 extends in the axial direction of the fixing belt 21 or the pressure roller 22 such that a longitudinal direction of the nip formation pad 24 is parallel to the axial direction of the fixing belt 21 or the pressure roller 22. The nip formation pad 24 is disposed on and supported by the support 25 (serving as a stay). Accordingly, even if the nip formation pad 24 is pressed by the pressure roller 22, the support 25 prevents the nip formation pad 24 from being bent by the pressure of the pressure roller 22 and thus allows the nip formation pad 24 to maintain a uniform nip length of the fixing nip N over the entire width of the pressure roller 22 in the axial direction of the pressure roller 22. Preferably, the support 25 is made of metal having an increased mechanical strength, such as stainless steel or iron, to prevent bending of the nip formation pad 24. Alternatively, the support 25 may be made of resin.

The nip formation pad 24 is made of a thermal resistant material with thermal-resistant temperature not lower than about 200° C. Thus, the nip formation pad 24 is immune from thermal deformation at temperatures in a fixing temperature range desirable to fix the toner image on the sheet P, thereby retaining the shape of the fixing nip N and the quality of the toner image formed on the sheet P. For example, the nip formation pad 24 is made of general thermal resistant resin such as polyether sulfone (PES), polyphenylene sulfide (PPS), liquid crystal polymer (LCP), polyether nitrile (PEN), polyamide imide (PAI), and polyether ether ketone (PEEK).

The reflector 26 is interposed between the support 25 and the halogen heater 23. In the present embodiment, the reflector 26 is secured to the support 25. Since the reflector 26 is directly heated by the halogen heater 23, the reflector 26 is desirably made of, for example, metal having a high-melting point. The reflector 26 thus disposed reflects the light radiated from the halogen heater 23 toward the support 25 to the fixing belt 21. Such reflection by the reflector 26 increases the amount of light that irradiates the fixing belt 21, thereby efficiently heating the fixing belt 21. The reflector 26 also prevents transmission of radiant heat from the halogen heater 23 to the support 25 and the like. Thus, energy saving can be achieved.

Alternatively, instead of installation of the reflector 26 in the present embodiment, an opposed surface of the support 25 disposed opposite the halogen heater 23 may be treated with mirror finishing such as polishing or coating to produce a reflection face that reflects light from the halogen heater 23 toward the fixing belt 21. Preferably, the reflector 26 or the reflection face of the support 25 has a reflectance of 90% or more. However, the shape and material of the support 25 may not be selected flexibly to retain the mechanical strength. As in the present embodiment, the reflector 26 disposed separately from the support 25 increases the flexibility in selecting the shape and material, thus allowing the reflector 26 and the support 25 to attain respective functions peculiar to the reflector 26 and the support 25. The reflector 26 interposed between the halogen heater 23 and the support 25 is disposed in proximity to the halogen heater 23, thus reflecting light from the halogen heater 23 toward the fixing belt 21 to effectively heat the fixing belt 21.

In order to further enhance the efficiency of heating the fixing belt 21 by light reflection, the direction of the reflector 26 or the reflection face of the support 25 is to be considered. For example, when the reflector 26 is disposed concentrically around the halogen heater 23 as the center, the reflector 26 reflects light toward the halogen heater 23, resulting in a decrease in heating efficiency. By contrast, when a part or all of the reflector 26 is disposed in a direction to reflect light toward the fixing belt 21, which is different from a direction to reflect light toward the halogen heater 23, the reflector 26 reflects less light toward the halogen heater 23, thereby enhancing the efficiency of heating the fixing belt 21 by the reflected light.

A description is now given of various structural advantages of the fixing device 20 to enhance energy saving and shorten a first print time taken to output the sheet P bearing the fixed toner image upon receipt of a print job through preparation for a print operation and the subsequent print operation. For example, the fixing device 20 employs a direct heating method in which the halogen heater 23 directly heats the fixing belt 21 in a circumferential direct heating span on the fixing belt 21 other than the fixing nip N. According to the present embodiment, no component is interposed between the left side of the halogen heater 23 and the fixing belt 21 in FIG. 2 such that the halogen heater 23 radiates heat directly to the circumferential direct heating span on the fixing belt 21.

In order to decrease the thermal capacity of the fixing belt 21, the fixing belt 21 is thin and has a decreased loop diameter. For example, the base layer of the fixing belt 21 is designed to have a thickness of from 20 μm to 50 μm; the elastic layer is designed to have a thickness of from 100 μm to 300 μm; and the release layer is designed to have a thickness of from 10 μm to 50 μm. Thus, the fixing belt 21 is designed to have a total thickness not greater than 1 mm. The loop diameter of the fixing belt 21 is in a range of from 20 mm to 40 mm. In order to further decrease the thermal capacity of the fixing belt 21, the fixing belt 21 may preferably have a total thickness not greater than 0.2 mm, and more preferably, not greater than 0.16 mm. Preferably, the loop diameter of the fixing belt 21 may be 30 mm or less.

According to the present embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, the curvature of the fixing belt 21 is smaller than the curvature of the pressure roller 22 at the fixing nip N, thus facilitating separation of the sheet P as the recording medium from the fixing belt 21 when the sheet P is ejected from the fixing nip N.

Figure 3:
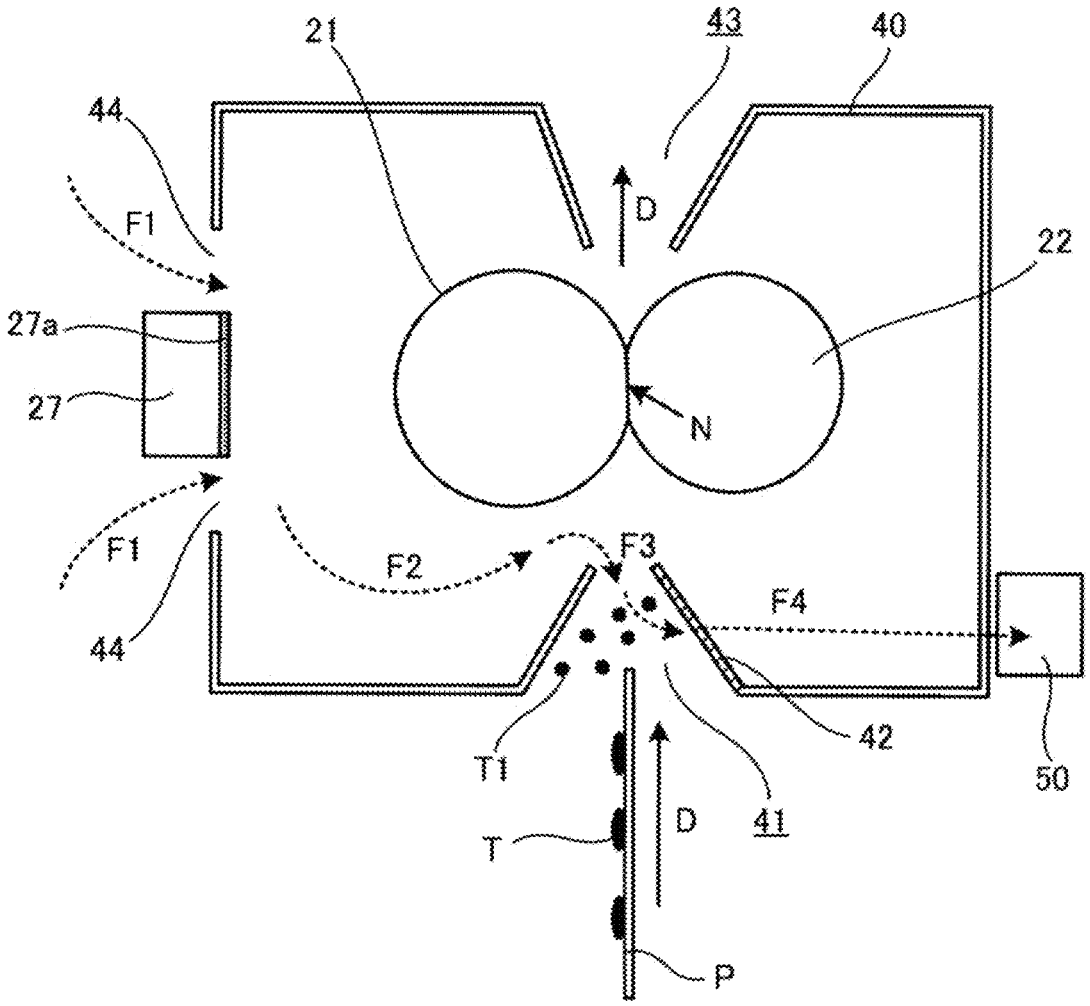
FIG. 3 is a schematic view of the fixing device according to an embodiment of the present disclosure.

FIG. 3 is a schematic view of the fixing device 20 according to an embodiment of the present disclosure. The fixing device 20 illustrated in FIG. 3 is disposed at a specified position with respect to the image forming apparatus 1 illustrated in FIG. 1. The configuration of the inside of the loop of the fixing belt 21 is substantially the same as that illustrated in FIG. 2. In other words, the fixing device 20 according to the present embodiment includes the fixing belt 21, the nip formation pad 24, the support 25, the pressure roller 22 serving as the opposite rotator, and the heat source 23 in a housing 40. The fixing belt 21 is an endless belt, and rotatable. The nip formation pad 24 is disposed inside the fixing belt 21. The support 25 supports the nip formation pad 24. The opposing rotator (serving as the pressure roller) 22 contacts the nip forming member 24 via the fixing belt 21 to form the fixing nip N with the fixing belt 21. The heat source 23 heats the fixing belt 21. The fixing device 20 further includes an inlet guide 42 that guides a sheet P serving as a recording medium to the fixing nip N in an inlet opening 41 to which the sheet P is conveyed. The fixing device 20 conveys the sheet P bearing an unfixed toner image T to the fixing nip N and fixes the unfixed toner image T on the sheet P.

The fixing device 20 according to the present embodiment further includes an airflow generator 51 (see FIG. 4) and an airflow guide member 52. The airflow generator 51 generates airflows F1 inside the housing 40. The airflow guide member 52 guides an airflow F2 toward the inlet opening 41. A flow of air F3 is generated in the inlet opening 41 in a direction different from the conveyance direction D of the sheet P. Such a configuration can prevent intrusion of scattered toner, indicated by reference numeral T1 in FIG. 3, into the fixing device 20. Thus, the adhesion of toner strains on the surface of the fixing belt 21 can be prevented.

The direction of the flow of air F3 generated in the inlet opening 41 is not particularly limited and may be any direction as long as the direction is different from the conveyance direction D of the sheet P and can prevent the intrusion of the scattered toner T1. The direction of the flow of air F3 is preferably opposite to the conveyance direction D of the sheet P.

Further, the airflow guide member 52 is not particularly limited and may be any member as long as the member can guide the airflows F1 generated by the airflow generator 51 toward the inlet opening 41. The airflow guide member 52 is preferably a member that guides the fixing belt 21 toward the inlet opening 41 without bringing the airflow F2 into contact with the fixing belt 21, in other words, without cooling the fixing belt 21. Examples of the airflow guide member 52 include a plate-shaped member that shields an airflow toward the fixing belt 21 and a member (e.g., pipe-shaped member) that forms a defined airflow passage.

The fixing device 20 according to the present embodiment includes the temperature detector 27 that detects the temperature of the fixing belt 21. The temperature detector 27 may be, for example, a thermopile. The temperature detector 27 may be held by the fixing device 20. In this case, securing a specified distance between the fixing belt 21 and the temperature detector 27 is necessary. Thus, the fixing device 20 may upsize. Therefore, the temperature detector 27 is preferably attached to the main body of the image forming apparatus 1 to which the fixing device 20 is installed, to measure the temperature of the fixing belt 21 from outside the fixing device 20. Attaching the temperature detector 27 to the main body of the image forming apparatus 1 allows the temperature detector 27 to remain in the main body of the image forming apparatus 1 when the fixing device 20 is removed from the main body of the image forming apparatus 1. Such a configuration can avoid parts replacement and contribute to a resource saving and a cost reduction in case of exchange services.

When the temperature detector 27 is attached to the main body of the image forming apparatus 1 outside the fixing device 20, a measurement opening 44 is disposed in the housing 40 of the fixing device 20. As indicated by arrows D in FIGS. 2 and 3, the sheet P is conveyed from the lower side to the upper side of the fixing device 20. When the sheet P passes through the fixing nip N heated to a specified temperature in order to fix the unfixed toner image on the sheet P, moisture contained in the sheet P is released. In addition, wax components contained in the toner are also released. There is no problem if the released moisture and wax components go toward the outlet (upward) together with the sheet P. For example, an airflow may be generated in the rotational direction of the fixing belt 21 (from a downstream outlet of the fixing nip N to the temperature detector 27) entrained by the rotation of the fixing belt 21. Moisture and wax components released from the sheet P are discharged toward the temperature detector 27 due to a gap of the measurement opening 44 and may adhere to a detecting face 27*a*. False detection may occur due to contamination of the detecting face 27*a*.

Figure 4:
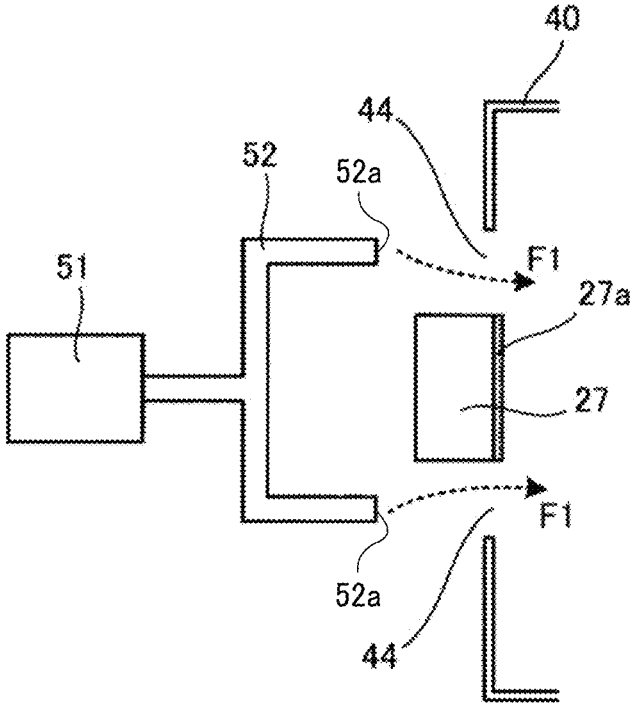
FIG. 4 is a schematic diagram illustrating an example of an airflow generator.

As illustrated in FIG. 4, the airflow generator 51 preferably generates the airflows F1 flowing forward of the detecting face 27*a* from behind the temperature detector 27. FIG. 4 is a schematic diagram illustrating an example of the airflow generator 51 and illustrating the relative positions of the airflow generator 51 and the temperature detector 27. As illustrated in FIG. 4, the airflow guide member 52 (serving as a duct) is disposed from the position of the airflow generator 51. A vent 52*a* of the airflow guide member 52 may be preferably disposed behind the temperature detector 27 toward a gap of the measurement opening 44. The vent 52*a* of the airflow guide member 52 may be in front of the temperature detector 27.

In this way, the airflow generator 51 generates the airflow F2 flowing forward of the detecting face 27*a* from behind the temperature detector 27 through the measurement opening 44. The airflow F2 is guided by the airflow guide member 52 toward the inlet opening 41. According to the fixing device 20 of the present embodiment, an airflow generated by the airflow generator 51 can prevent the scattered toner T1 from entering the fixing device 20 and also prevent contamination of the detecting face 27*a* of the temperature detector 27.

Figure 5:
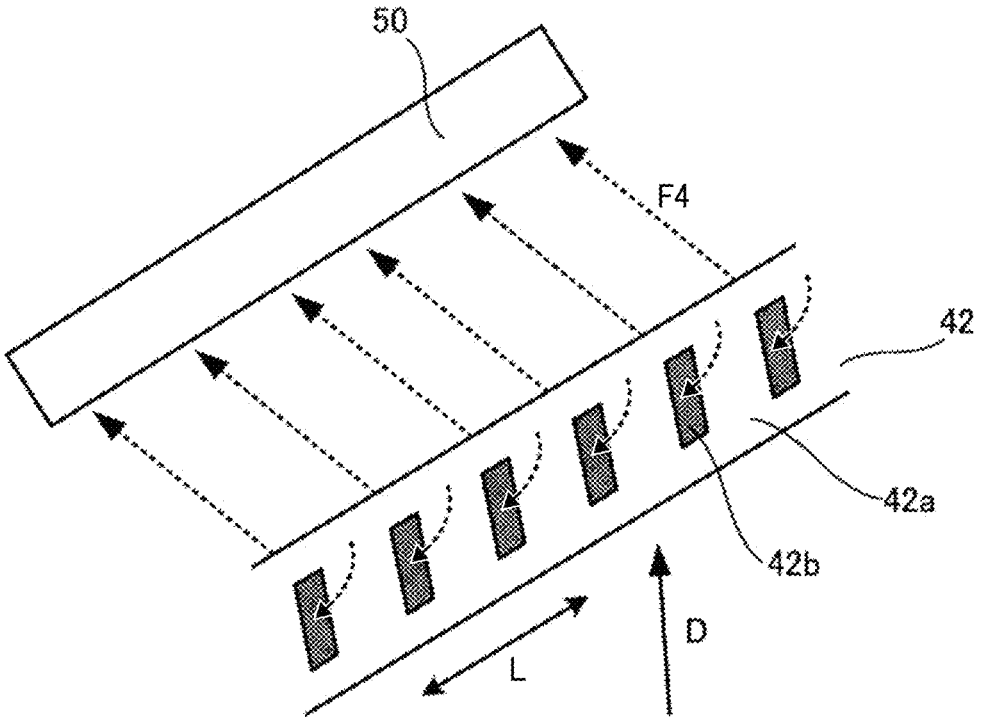
FIG. 5 is a schematic diagram illustrating air intake via an inlet guide.

The fixing device 20 according to the present embodiment includes an intake device 50 to draw air in the inlet opening 41. As illustrated in FIG. 5, the inlet guide 42 has a plurality of vents 42*b* disposed along the longitudinal direction L on a face 42*a* to face the sheet P to be conveyed, and the intake device 50 draws air in the inlet opening 41 through the vent 42*b*. Flows of air F4 due to air intake are indicated in FIG. 5. As illustrated in FIG. 5, the intake device 50 draws air from the opposite face of the inlet guide 42 opposite to the face 42*a* to face the sheet P.

The intake device 50 draws air from the inlet opening 41 via the vents 42*b*. Such a configuration can more reliably prevent the scattered toner T1 from entering the fixing device 20 and prevent the adhesion of toner stains on the surface of the fixing belt 21.

The intake device 50 is preferably disposed away from at least the fixing belt 21. Specifically, as illustrated in FIG. 3, the intake device 50 is preferably disposed outside the housing 40. It is also preferable that the flows of air F4 generated by air intake do not contact the fixing belt 21 and do not cool the fixing belt 21.

With the above-described configuration, even if the amount of input toner is large, including toner scattered from the photoconductor 5 and scumming toner generated in the secondary transfer area, the fixing device according to present embodiment can prevent intrusion of the scattered toner T1 and prevent the adhesion of toner strains on the surface of the fixing belt 21 without a mechanism to clean the surface of the fixing belt 21.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A fixing device comprising:

a rotatable fixing belt of an endless shape to fix an unfixed image on a recording medium conveyed to a fixing nip;

a nip formation pad disposed inside a loop of the fixing belt:

a support supporting the nip formation pad;

an opposing rotator abutting on the nip formation pad via the fixing belt to form the fixing nip between the opposing rotator and the fixing belt;

a heat source to heat the fixing belt;

a housing accommodating the fixing belt, the nip formation pad, the support, the opposing rotator, and the heat source, the housing having an inlet opening to receive the recording medium;

an inlet guide disposed at the inlet opening to guide the recording medium to the fixing nip, the inlet guide narrowing the inlet opening with an increasing depth into the housing;

an airflow generator to generate an airflow in the housing;

an airflow guide to guide the airflow toward the inlet opening to generate a flow of air in the inlet opening in a direction different from a conveyance direction in which the recording medium is conveyed to the inlet opening;

an intake device to draw air into the housing; and a plurality of vents disposed along a longitudinal direction of the inlet guide on a surface of the inlet guide to face the recording medium conveyed to the inlet opening, wherein the intake device is to draw the air which is in the housing and is from the airflow generator out of the housing through the inlet opening and back into the housing through the plurality of vents.

2. The fixing device according to claim 1, wherein the flow of air generated in the inlet opening is in a direction opposite to the conveyance direction.

3. The fixing device according to claim 1, wherein the airflow guide is to guide the airflow generated by the airflow generator toward the inlet opening without contacting the airflow with the fixing belt.

4. The fixing device according to claim 1, further comprising a temperature detector having a detecting face to detect a temperature of the fixing belt, wherein the airflow generator is to generate an airflow flowing forward of the detecting face from behind the temperature detector.

5. The fixing device according to claim 4, wherein the airflow guide is connected to the airflow generator, and wherein the airflow guide has a vent directed behind the temperature detector.

6. The fixing device according to claim 1, wherein the intake device is disposed away from the fixing belt.

7. An image forming apparatus comprising the fixing device according to claim 1.

8. A fixing device comprising:

a rotatable fixing belt of an endless shape to fix an unfixed image on a recording medium conveyed to a fixing nip;

a nip formation pad disposed inside a loop of the fixing belt;

a support supporting the nip formation pad;

an opposing rotator abutting on the nip formation pad via the fixing belt to form the fixing nip between the opposing rotator and the fixing belt;

a heat source to heat the fixing belt;

a housing accommodating the fixing belt, the nip formation pad, the support, the opposing rotator, and the heat source, the housing having an inlet opening to receive the recording medium;

a means for guiding the recording medium to the fixing nip by narrowing the inlet opening with an increasing depth into the housing;

an airflow generator to generate an airflow in the housing;

an airflow guide to guide the airflow toward the inlet opening to generate a flow of air in the inlet opening in a direction different from a conveyance direction in which the recording medium is conveyed to the inlet opening;

an intake device to draw air into the housing; and a plurality of vents disposed along a longitudinal direction of the means for guiding on a surface of the means for guiding to face the recording medium conveyed to the inlet opening, wherein the intake device is to draw the air which is in the housing and is from the airflow generator out of the housing through the inlet opening and back into the housing through the plurality of vents.

9. The fixing device according to claim 8, wherein the flow of air generated in the inlet opening is in a direction opposite to the conveyance direction.

10. The fixing device according to claim 8, wherein the airflow guide is to guide the airflow generated by the airflow generator toward the inlet opening without contacting the airflow with the fixing belt.

11. The fixing device according to claim 8, further comprising a temperature detector having a detecting face to detect a temperature of the fixing belt, wherein the airflow generator is to generate an airflow flowing forward of the detecting face from behind the temperature detector.

12. The fixing device according to claim 11, wherein the airflow guide is connected to the airflow generator, and wherein the airflow guide has a vent directed behind the temperature detector.

13. The fixing device according to claim 8, wherein the intake device is disposed away from the fixing belt.

14. An image forming apparatus comprising the fixing device according to claim 8.

15. A fixing device comprising:

a rotatable fixing belt of an endless shape to fix an unfixed image on a recording medium conveyed to a fixing nip;

a nip formation pad disposed inside a loop of the fixing belt:

a support supporting the nip formation pad;

an opposing rotator abutting on the nip formation pad via the fixing belt to form the fixing nip between the opposing rotator and the fixing belt;

a heat source to heat the fixing belt;

a housing accommodating the fixing belt, the nip formation pad, the support, the opposing rotator, and the heat source, the housing having an inlet opening to receive the recording medium;

an inlet guide disposed at the inlet opening to guide the recording medium to the fixing nip, the inlet guide narrowing the inlet opening with an increasing depth into the housing;

an intake device to draw air into the housing; and a plurality of vents disposed along a longitudinal direction of the inlet guide on a surface of the inlet guide to face the recording medium conveyed to the inlet opening, wherein the intake device is to draw the air which is in the housing out of the housing through the inlet opening and through the plurality of vents back into the housing.

16. The fixing device according to claim 15, wherein:

a flow of air out of the housing at the inlet opening is in a direction opposite to a conveyance direction of the recording medium into the housing.

* * * * *